US008608115B2

(12) United States Patent
Ruetzel et al.

(10) Patent No.: US 8,608,115 B2
(45) Date of Patent: Dec. 17, 2013

(54) ROLLER SUPPORT FOR THE POINT RAIL OF A RAILROAD SWITCH

(75) Inventors: Tilmann Ruetzel, Constance (DE); Frank Meyer, Stockach (DE); Bernd Wientges, Constance (DE)

(73) Assignee: Schwihag AG, Taegerwilen (CH)

( * ) Notice: Subject to any disclaimer, the term of this patent is extended or adjusted under 35 U.S.C. 154(b) by 133 days.

(21) Appl. No.: 13/173,442

(22) Filed: Jun. 30, 2011

(65) Prior Publication Data

US 2012/0001030 A1 Jan. 5, 2012

(30) Foreign Application Priority Data

Jul. 1, 2010 (DE) ..... 10 2010 025 770

(51) Int. Cl.
*E01B 7/02* (2006.01)

(52) U.S. Cl.
USPC ..... 246/453; 246/435 R; 246/430

(58) Field of Classification Search
USPC ..... 246/415 R, 430, 435 R, 442, 443, 453
See application file for complete search history.

(56) References Cited

U.S. PATENT DOCUMENTS

| | | | | |
|---|---|---|---|---|
| 5,501,418 | A * | 3/1996 | Humphrey et al. | 246/453 |
| 5,509,626 | A | 4/1996 | Fodor | |
| 5,628,480 | A * | 5/1997 | Vrsecky et al. | 246/453 |
| 6,189,840 | B1 * | 2/2001 | Mantovan et al. | 246/453 |

FOREIGN PATENT DOCUMENTS

DE 29509542 U 9/1995

* cited by examiner

*Primary Examiner* — Zachary Kuhfuss
(74) *Attorney, Agent, or Firm* — Andrew Wilford

(57) ABSTRACT

A point rail is shiftable transversely on an upper face of a rail base plate between an engaged position bearing on a longitudinally extending and fixed stock rail and a disengaged position spaced transversely of the stock rail. A roller assembly has a mounting plate securable to the rail base plate, a roller support pivotal about a support axis on the rail base plate, a roller carried on the roller support, and a spring biasing the roller upward with a predetermined spring force into a lift position with the roller projecting upward past the upper face for supporting the point rail on the roller. Thus this assembly supports the point rail and, in the engaged position, presses it against the support cleats and the stock rail and it is an integral part of one of the rail base plates.

9 Claims, 2 Drawing Sheets

ROLLER SUPPORT FOR THE POINT RAIL OF A RAILROAD SWITCH

FIELD OF THE INVENTION

The present invention relates to a railroad switch. More particularly this invention concerns a roller support for such a railroad switch.

BACKGROUND OF THE INVENTION

A typical railroad switch has a pair of point rails movable into and out of engagement with respective stock rails for diverting a train on the stock rails to a siding or other track. Each of the point rails is moved by a roller assembly comprising a support carrying at least one roller and resiliently supported on a rail base plate formed as a slide plate or slide chair. The point rail is supported on the roller at least during a switching process.

Roller assemblies designed in such a manner are well known from the prior art and allow the point rail to be slightly lifted during the opening or switching process and therefore not in contact anymore with the slide chair or the slide surface of the rail base plate. In so doing, the point rail moves over a roller or rolling bodies that effect a significant reduction of the switching forces and allow the slide chairs or slide surfaces to be lubricant-free.

For an accurate height adjustment of the uppermost tangent plane of the rollers, the same are resiliently mounted as described, for example, in DE 295 09 542.

The roller mounting has a pure load-bearing function here during the switching process so that the point rail, in the position in which it abuts against the stock rail, rests on the slide chair or the slide surface of the rail base plate.

In this so-called closed state, the point rail bears within the switch arrangement with its point tip against the stock rail and with its root region or point rail web against support cleats or spacer blocks. After a long period of use, i.e. by running many times over the point rail with the full wheel load in the root region, the given or pre-bent shape of the point rail changes in the longitudinal direction of the rail. As a result of the shape change, the point rail no longer comes into abutment in the web region with the support cleats or spacer blocks. When running over the point rail, this state can result in significant wear on the slide chairs or the slide surfaces of the rail base plates because the point rail is brought in an undesirable manner into abutment against the support cleats only by the transverse force of the wheel running over the point rail. Here, very significant friction forces occur between the bottom side of the point foot and the slide chair or the slide surfaces of the respective rail base plates as a result of the additionally vertical vector of wheel force.

In order to avoid this disadvantage it became known from EP 0 654 561 [U.S. Pat. No. 5,509,626] that a roller support having at least one holder for at least one roller is mounted to resiliently move in a direction toward the stock rail, the point rail abutting via the roller against the stock rail and therefore, the resistance during the movement of the point rail is kept low.

To this end, the roller is partially slid underneath the point rail by a leaf spring. Spacers make it then possible to adequately fix the roller against the force of a separate spring and in abutment against the foot of the point rail.

This roller assembly is mounted via the leaf springs and retaining elements provided at its ends on two adjacent switch sleepers of a track bed and therefore lies in the center of the space between two sleepers.

As a result, the roller assembly projects into the tamping region for ballast underneath the switch sleepers. This means that the roller assembly has to be disassembled prior to tamping the ballast, then reassembled and subsequently readjusted.

Further, this roller assembly can only be assembled after the switch system has been installed on site. This results in work-related additional expenses and time delays on the construction site.

OBJECTS OF THE INVENTION

It is therefore an object of the present invention to provide an improved roller support for the point rail of a railroad switch.

Another object is the provision of such an improved roller support for the point rail of a railroad switch that overcomes the above-given disadvantages, in particular in which the rollers can be exactly positioned vertically as well as horizontally with respect to the point rail.

A further object is to provide such a roller assembly that can be retrofitted without a major amount of work to an existing switch of conventional design.

SUMMARY OF THE INVENTION

A point rail is shiftable transversely on an upper face of a rail base plate between an engaged position bearing on a longitudinally extending and fixed stock rail and a disengaged position spaced transversely of the stock rail. A roller assembly has according to the invention a mounting plate securable to the rail base plate, a roller support pivotal about a support axis on the rail base plate, a roller carried on the roller support, and a spring biasing the roller upward with a predetermined spring force into a lift position with the roller projecting upward past the upper face for supporting the point rail on the roller. Thus this assembly supports the point rail and, in the engaged position, presses it against the support cleats and the stock rail and it is an integral part of one of the rail base plates.

With the roller assembly according to the invention, switching the point rail can also be done with a plurality of rollers arranged one behind the other or side by side in the roller support so that there is no connection to adjacent switch sleepers or rail base plates of a switch system. The tamping region is free of structure and is freely accessible at any time.

This means that the mounting plate and the roller support that is pivotable via the pivot axle thereon as well as a spring subassembly acting on the roller support with a preset spring force can be preassembled on the rail base plate in a workshop. On site, in the switch system, the only thing necessary during the initial installation of the roller assembly, for example on a track sleeper, is to adjust the horizontal spacing between the roller support and the stock rail or point rail. To this end, the mounting plate is advantageously provided with slots extending in the longitudinal direction of the rail base plate.

In a preferred configuration of the invention the roller support is a two-arm lever having a horizontally extending arm that holds the roller and a vertically downwardly extending arm that is biased by the spring subassembly. The two-arm lever and the spring subassembly acting on the vertical arm extend transverse to the stock rail and are under the point rail. Thus, they are located directly laterally beside the rail base plate between two switch sleepers or rail fastening points. On the one hand, this arrangement offers good protection against damage and, on the other, at the same time, a sufficiently large free space between the switch sleepers so that consolidating the ballast in this region by tamping can be done even after installation of the roller assembly.

An advantageous configuration of the invention provides that the spring subassembly has a spring braced in a housing on a disk of a piston rod and at the opposite end on a housing wall, the piston rod passing with clearance through the vertical arm of the roller support and an abutment formed on the mounting plate and arranged below the horizontal arm to the roller, and a threaded nut is screwed onto the protruding threaded end of the piston rod. The spring subassembly connected in this manner to the roller support and the mounting plate acts via its spring, for example a disk or spiral spring, on the vertical arm of the roller support with a defined, continuously applied spring force.

In the position of the point rail remote from the stock rail or, respectively, during the switching process from the engaged position abutting against the stock rail into the disengaged position, the roller support is pushed downward against the spring force via the point rail foot resting on the roller and the weight of the point rail. The biasing of the spring means is selected such that despite the load of the point rail, the outer periphery of the roller lies above the rail base plate and therefore the point rail rests in the disengaged position or during the switching process on the roller and is clear of the rail base plate.

In the point rail's position abutting the stock rail, the so-called engaged position of the switch, the spring subassembly applies biasing force that pivots the roller support toward abutment with the mounting plate, and the foot of the point rail drops off the roller to sit solidly on the upper slide face of the chair or base plate. Along with this, the roller engaged below its outer periphery against the point foot of the point rail and presses it with the preset, defined spring force against the stock rail or the support cleats.

BRIEF DESCRIPTION OF THE DRAWING

The above and other objects, features, and advantages will become more readily apparent from the following description, reference being made to the accompanying drawing in which.

DETAILED DESCRIPTION

Figure 1:
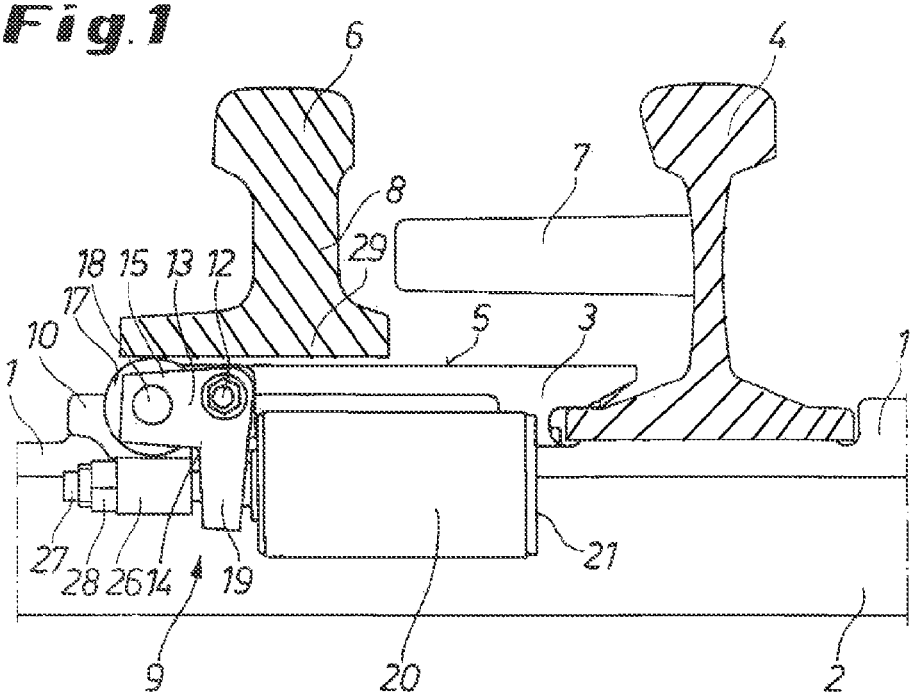
FIG. 1 is a vertical section through a roller assembly on a switch sleeper of a switch with the point rail disengaged from the stock rail.
Figure 2:
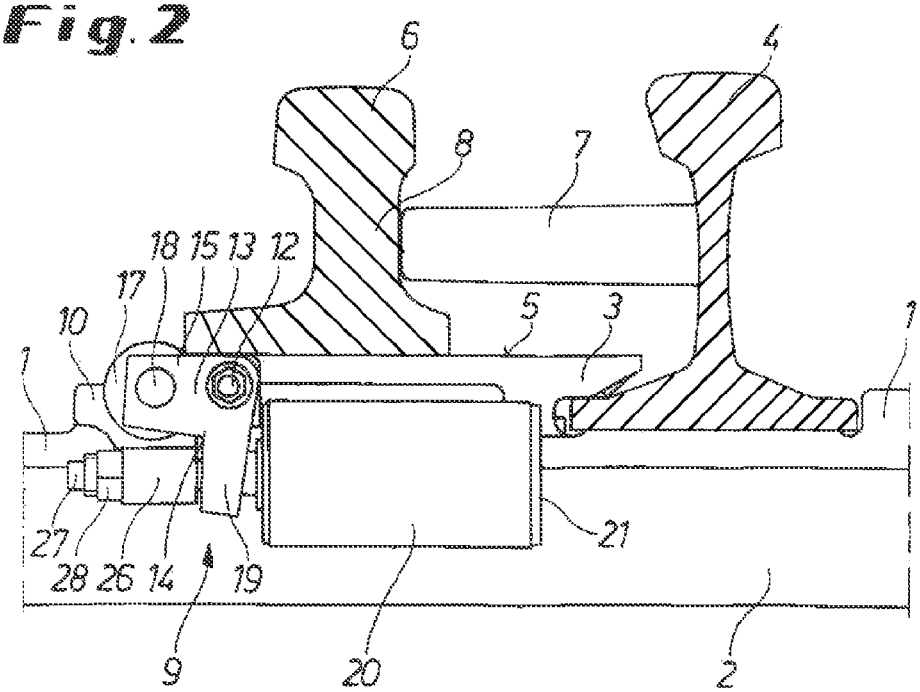
FIG. 2 is a view like FIG. 1 but with the point rail engaging the stock rail.
Figure 3:
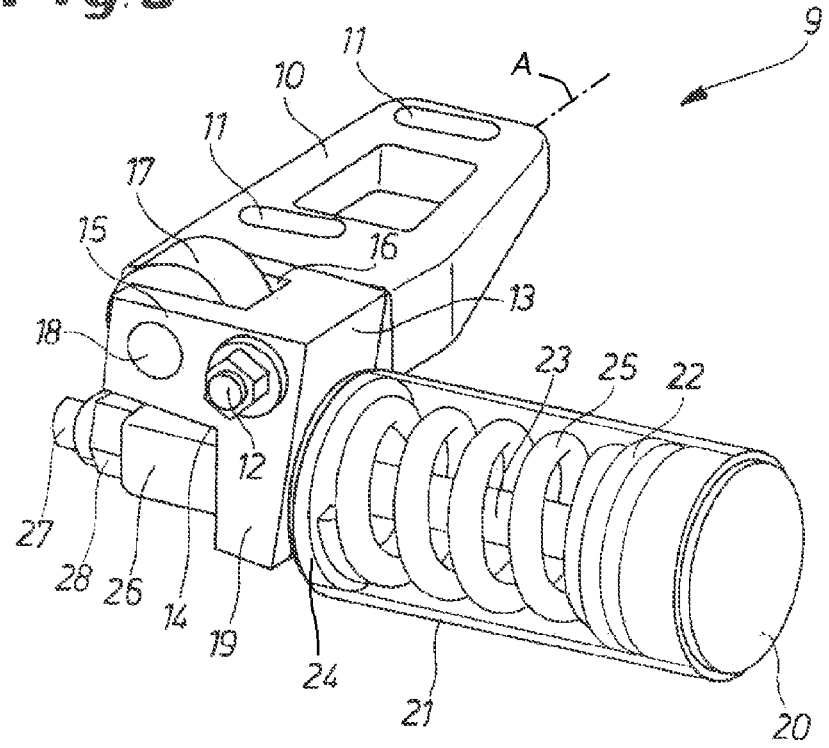
FIG. 3 is a perspective view of just the roller assembly.
Figure 4:
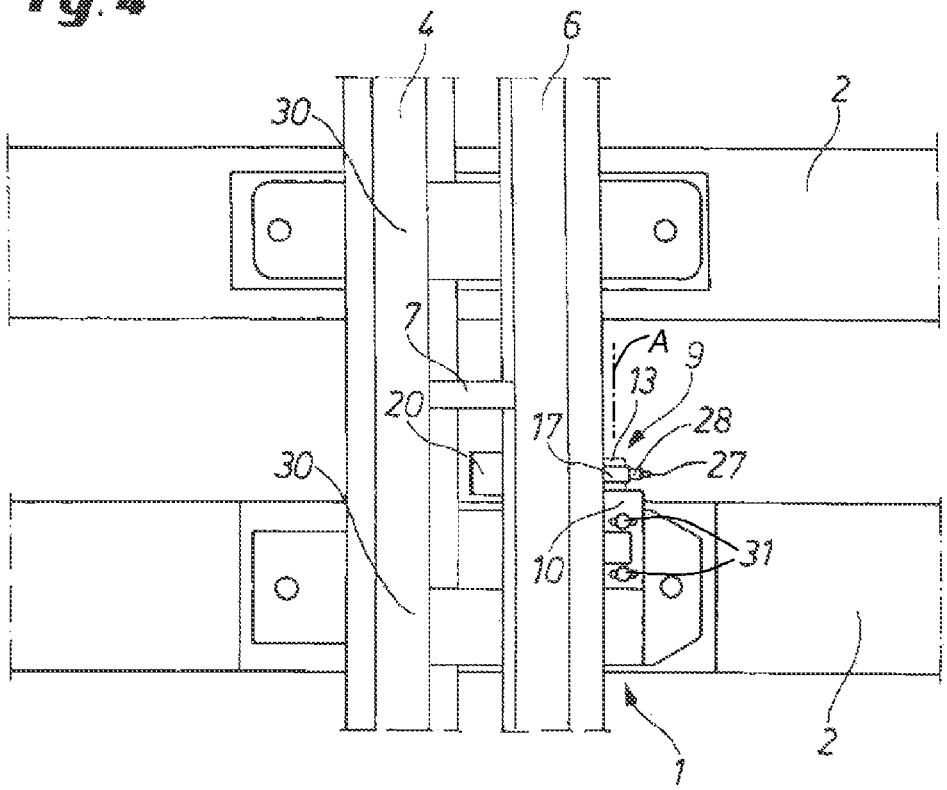
FIG. 4 is a top view of the structure in the engaged position as seen in FIG. 2.

As seen in FIGS. 1, 2, and 4, one of two railroad stock rails 4 running parallel and spaced apart from each other is secured by respective standard base plates 1 to two transversely extending concrete sleepers 2, one of which is provided with a switch according to the invention. The rail base plate 1 is formed with a slide chair 3 fitting at one side with the foot of the stock rail 4 and that, on its planar upper face, forms a support face 5 for a point rail 6.

Spacers or cleats 7, one of which is shown in the drawing, project transversely from the stock rail 4 toward the point rail 6. In the switch, the point rail 6 abuts in the engaged position along the length of the switch against the stock rail 4 in a slightly curved course, i.e. at one end spaced by the support cleats 7 that abut against the point rail web 8 as shown in the FIGS. 2 and 4 and, at the other end, with the tip of the point rail 6 abutting directly against the stock rail 4.

A roller assembly 9 is provided for supporting the point rail 6 as it moves between a disengaged position remote from the stock rail 4 (FIG. 1) and an engaged position bearing directly or indirectly via the cleats on the stock rail (FIG. 2).

The roller assembly 9 has a mounting plate 10 that is displaceable transversely of the stock rail 4 via transversely elongated slots 11 for positioning it and, in the adjusted end position, fixedly connecting it, for example by nuts 31, to the rail base plate 1.

At an end of the mounting plate 10 that projects beyond the edge of the rail base plate 1 and the switch sleeper 2, a roller support 13 is pivotable on a horizontal pivot axle 12 fixed in the mounting plate 10 and extending longitudinally parallel to the stock rail 4. The roller holder 13 is a two-arm lever 14 having a horizontally extending forked arm 15 that receives a roller 17 in a U-shaped intermediate space 16 where it is mounted in a free-running manner on a pivot axle 18. A vertically downwardly extending arm 19 of the roller holder 13 is pressed by a spring subassembly 20 with a permanent spring force in a direction urging the roller 17 in an arc upward and horizontally toward the stock rail 4. FIG. 4 shows how the roller holder 13 is between two switch sleepers 2, and optionally between two rail fastening locations 30. It also is immediately next to the sleeper carrying its plate 1 and largely underneath the point rail 4, so that when ballast is tamped between the sleepers 2 it is does not get in the way.

The spring subassembly 20 has a cylindrical housing 21 that is secured to the vertical arm 19 and normally extends horizontally but at least in a vertical plane perpendicular to the stock rails 4. This housing 21 holds a spiral spring 25 braced at one end against a disk 22 of a piston rod 23 and at the opposite end on a housing wall 24 itself fixed to the arm 19. The piston rod 23 projects out of the housing 21 and passes with clearance through the vertical arm 19 of the roller holder 13 and through an abutment 26 formed on the mounting plate 10. A threaded nut 28 is screwed onto a free threaded end 27 of the piston rod 23. By loosening or tightening the threaded nut 28, the prestress of the spiral spring 25 can be varied and thus a defined spring force can be set that the roller 17 exerts mainly upward.

The variation of the spring force allows a height adjustment of the roller 17 with respect to the support face 5 of the slide chair 3. This allows adjustment of the extent the outer periphery of the roller 17 projects upward beyond the support face 5 and, as a result, a foot 29 of the point rail 6 is lifted off the support face 5 to a greater or lesser extent (see FIG. 1).

In the engaged position according to FIG. 2 in which the foot 29 of the point rail 6 rests on the support face 5 and the point rail 6 is pressed directly or indirectly via the spacers 7 against the stock rail 4, the spiral spring 25 extends and pivots the roller holder 13 with its vertical arm 19 toward the abutment 26, so that then the roller 17 presses the point rail 6 with a defined spring force horizontally toward the support cleats 7 to bear on it horizontally with a predetermined spring force on it. To ensure this function, the vertical arm 19 keeps always is at a slight spacing from the abutment 26.

If now vibrations are transmitted into the point rail 6 when the switch is run over, the vibrations can be absorbed and damped so that there is no chattering of the point rail 6 against the support cleat 7 or the support face 5

We claim:

1. In combination with a longitudinally extending and fixed stock rail and a point rail shiftable transversely on an upper face of a rail base plate between an engaged position bearing on the stock rail and a disengaged position spaced transversely of the stock rail, a roller assembly comprising:

a mounting plate securable to the rail base plate;

a two-arm roller-support lever pivotal about a support axis on the rail base plate and having a horizontal arm and a vertical arm;

a roller carried on the horizontal arm of the roller-support lever; and spring means braced between the mounting plate and the vertical arm of the roller-support lever for biasing the roller upward with a predetermined spring force into a lift position with the roller projecting upward past the upper face for supporting the point rail on the roller.

2. The roller assembly defined in claim 1 wherein the spring means includes a spring.

3. The roller assembly defined in claim 2 wherein the vertical arm is engaged by an end of the spring.

4. The roller assembly defined in claim 3, further comprising:

an abutment fixed on the mounting plate;

a cylindrical housing containing the spring, the vertical arm being between the abutment and the housing;

an end plate bearing on an opposite end of the spring;

a rod connected to the end plate and passing with clearance through the spring, through the vertical arm, and through the abutment; and a nut threaded on an outer end of the rod.

5. The roller assembly defined in claim 4 wherein the spring is a coil spring or a stack of spring washers and the spring and housing extend transversely of the stock rail underneath the rails.

6. The roller assembly defined in claim 1 wherein the support axis extends horizontally generally parallel to the stock rail.

7. The roller assembly defined in claim 6 wherein the roller is rotatable on the support about a roller axis parallel to the support axis.

8. The roller assembly defined in claim 1 wherein the mounting plate is formed with slots extending perpendicular to the stock rail, the assembly further comprising:

screw fasteners passing through the slots and fixed in the rail base plate for securing the mounting plate thereto in any of a multiplicity of positions at different respective transverse spacings relative to the stock rail.

9. In combination with a longitudinally extending and fixed stock rail and a point rail shiftable transversely on an upper face of a rail base plate between an engaged position bearing on the stock rail and a disengaged position spaced transversely of the stock rail, a roller assembly comprising:

a mounting plate securable to the rail base plate;

a roller support pivotal about a support axis parallel to the stock rail on the rail base plate;

a roller rotatable on the roller support about a roller axis parallel to the support axis; and spring means for biasing the roller upward with a predetermined spring force into a lift position with the roller projecting upward past the upper face for supporting the point rail on the roller, the support axis being so oriented relative to the upper face and the roller support being so spaced from the stock rail that in a position where the point rail is pressed directly or indirectly against the stock rail the roller bears horizontally on a foot of the point rail toward the stock rail.

* * * * *